US005614791A

United States Patent [19]

Kume et al.

[11] Patent Number: 5,614,791

[45] Date of Patent: Mar. 25, 1997

[54] CATHODE RAY TUBE

[75] Inventors: Hisao Kume, Kanagawa; Hiromu Hosokawa, Chiba; Minoru Watanabe; Kenichiro Takayanagi, both of Kanagawa, all of Japan

[73] Assignee: Sony Corporation, Tokyo, Japan

[21] Appl. No.: 673,015

[22] Filed: Jul. 1, 1996

Related U.S. Application Data

[63] Continuation of Ser. No. 354,002, Dec. 5, 1994, abandoned.

[30] Foreign Application Priority Data

Dec. 10, 1993 [JP] Japan ..... 5-310601

[51] Int. Cl.[6] ..... H01J 29/56

[52] U.S. Cl. ..... 315/370; 315/8

[58] Field of Search ..... 315/370, 8, 85; 361/150

[56] References Cited

U.S. PATENT DOCUMENTS

| | | | |
|---|---|---|---|
| 2,921,226 | 1/1960 | Vasilevskis . | |
| 3,887,833 | 6/1975 | Yamazaki . | |
| 4,829,214 | 5/1989 | Lendaro | 315/8 |
| 4,950,955 | 8/1990 | Hoover et al. | 315/8 |
| 4,963,789 | 10/1990 | Buhler | 315/8 |
| 4,996,461 | 2/1991 | Bentley | 315/8 |
| 5,017,832 | 5/1991 | Takita | 315/8 |
| 5,066,891 | 11/1991 | Harrold et al. . | |
| 5,179,315 | 1/1993 | Lonoce et al. | 315/8 |
| 5,367,221 | 11/1994 | Santy et al. | 315/8 |

FOREIGN PATENT DOCUMENTS

| | | |
|---|---|---|
| 0039502A1 | 11/1981 | European Pat. Off. . |
| 0262614 | 4/1988 | European Pat. Off. . |
| 0396381A3 | 11/1990 | European Pat. Off. . |
| 0421592A2 | 4/1991 | European Pat. Off. . |
| 2629635 | 10/1989 | France . |
| 3935710A1 | 8/1990 | Germany . |

OTHER PUBLICATIONS

Patent Abstracts of Japan, vol. 7, No. 251, Nov. 8, 1983, entitled "Dynamically Compensating Circuit of Unnecessary Magnetic Field".

*Primary Examiner*—Theodore M. Blum
*Attorney, Agent, or Firm*—Hill, Steadman & Simpson

[57] ABSTRACT

A cathode ray tube apparatus can accurately, easily and automatically correct influences exerted on both of a beam landing drift and an image distortion drift by terrestrial magnetism applied to a cathode ray tube (CRT). A correction current based on an output of a terrestrial magnetism sensor (45) is supplied to a Z-axis correction coil (41) and an X—X axis correction coil (42). A terrestrial magnetism component ($B_H \cos\theta$) of Z-axis direction is canceled by a correction magnetic flux generated by the Z-axis correction coil (41), and a terrestrial magnetism component ($B_H \sin\theta$) of X-axis direction is canceled by the X—X axis correction coil (42), whereby a beam landing drift and a image distortion drift are corrected automatically.

8 Claims, 13 Drawing Sheets

CATHODE RAY TUBE

This is a continuation, of application Ser. No. 08/354,002, filed Dec. 5, 1994 now abandoned.

BACKGROUND OF THE INVENTION

1. Field of the Invention

The present invention relates to a cathode ray tube apparatus having a cathode ray tube, which is used in an information terminal device for displaying characters and graphics and, more particularly, the present invention is directed to a cathode ray tube apparatus in which a beam landing drift and an image drift distortion which is caused by the influence of terrestrial magnetism is corrected.

2. Description of the Related Art

In a cathode ray tube apparatus, such as a television receiver or display apparatus having a color cathode ray tube (referred to hereinafter as "CRT" when necessary) with a color selection mask, such as an aperture grille or shadow mask, it is known that beam landing and image distortion are affected by terrestrial magnetism.

FIGS. 1 to 3 of the accompanying drawings show measured results of beam landing drift caused by terrestrial magnetism.

FIG. 1 shows measured results of drifts of landing patterns 1, 2 and 3 obtained when a face plate 10 of a cathode ray tube is faced to the direction East (E), the direction South (S), the direction West (W) and the direction North (N), respectively. Dotted line patterns in FIG. 1 depict reference line patterns obtained when there is no terrestrial magnetism, i.e., when there is no external magnetic field. Solid line patterns in FIG. 1 depict actual patterns changed by the terrestrial magnetism. When the face plate 10 of the cathode ray tube is faced to the direction East (E) and the direction West (W), the center patterns are placed at the same position in which the reference line pattern 1 is obtained in the absence of the terrestrial magnetism and the practical pattern 1 overlap each other.

FIG. 2 shows a beam landing drift amount Δ obtained between a particular color beam 4 shown by a solid line and a beam 5 shown by a dashed line when the beam 4 is displaced in the direction shown by an arrow A. Specifically, the beams 4 and 5 bombards a fluorescent substance 8 of a particular color coated on the face plate 10 through an opening (slit or hole) in a color selection mask 6. In order to obtain a satisfactory color purity, it is an indispensable condition that a particular color beam, e.g., a green beam 4 should bombard the fluorescent substance 8 of this particular color.

FIG. 3 is a diagram showing plotted results of the beam landing drift obtained at six points (see FIG. 1) of the picture screen end portion when the cathode ray tube is rotated one time within the horizontal plane in the magnetic field caused by terrestrial magnetism under the condition that the tube axis of the cathode ray tube is laid in the horizontal direction. Study of FIG. 3 reveals that a beam landing drift amount Δ is regularly changed in a sine wave fashion. In FIG. 3, the beam landing drift amount Δ to the right-hand side as seen from the front surface of the face plate 10 is defined as a positive drift amount +Δ, and the beam landing drift amount Δ to the left-hand side is defined as a negative drift amount −Δ.

FIG. 4 shows measured results of the changes of image distortion patterns obtained when image distortion patterns are changed by terrestrial magnetism. Specifically, FIG. 4 shows the changes of image distortion patterns obtained when the face plate 10 of the cathode ray tube is faced to the direction East (E), the direction South (S), the direction West (W) and the direction North (N), respectively. Dotted line patterns in FIG. 4 represent reference image distortion patterns obtained in the absence of terrestrial magnetism, i.e., when there is no external magnetic field. Solid line image distortion patterns in FIG. 4 represent practical image distortion patterns obtained when the image distortion is changed by terrestrial magnetism.

The beam landing drift and the change of the image distortion patterns due to the terrestrial magnetism become factors which deteriorate characteristics, such as color purity and pattern distortion of the cathode ray tube apparatus.

In order to reduce the factors under which characteristics are deteriorated by terrestrial magnetism, there have been proposed the following three techniques:

(1) reducing the terrestrial magnetic field with a magnetic shield (magnetic shield plate);

(2) reducing the terrestrial magnetic field with a degauss coil; and (3) reducing the terrestrial magnetic field with a correction coil.

The above three techniques (1) to (3) will be described below, respectively.

(1) Reduction technique based on a magnetic shield:

As a reduction technique based on a magnetic shield, there are known CRT external magnetic shields and CRT internal magnetic shields. According to the magnetic shield technique, a magnetic field generated by terrestrial magnetism is weakened so that the beam landing drift amount and the changed amount of the image distortion can be reduced.

(2) Reduction technique based on a degauss coil:

The reduction technique based on a degauss coil is a technique in combination with the (1) reduction technique on which uses magnetic shield. According to this reduction technique, a degauss coil is attached to the tube side wall of the CRT and the degauss coil is supplied with an AC attenuation current. The magnetic shield and the color selection mask are thereby degaussed. Thus, the electron beam proceeds on its desired path to thereby reduce the influence of terrestrial magnetism.

(3) Reduction technique based on a correction coil:

The reduction technique based on a correction coil has hitherto been applied to a picture tube of a television receiver having a wide picture screen of about 25-inch or greater with a small beam landing allowance and a high-definition display tube. Japanese laid-open patent publication No. 4-61590 published on Feb. 27, 1992, for example, describes such a reduction technique based on a correction coil.

FIG. 5 is a schematic diagram showing a front arrangement of a cathode ray tube to which the reduction technique based on a correction coil is applied.

FIG. 6 is a schematic block diagram showing a fundamental arrangement of a correction circuit applied to the example shown in FIG. 5.

As shown in FIG. 5 and, as seen from the face plate 10 side of the cathode ray tube, 6 correction coils LCC-LT (landing correction coil left top), LCC-CT (landing correction coil center top), LCC-RT (landing correction coil right top), LCC-LB (landing correction coil left bottom), LCC-CB (landing correction coil center bottom) and LCC-RB (landing correction coil right bottom) are disposed at designated positions around the face plate 10 side.

As shown in FIG. 6, the correction coils LCC-LT, LCC-CT, LCC-RT, LCC-LB, LCC-CB and LCC-RB are driven based on a direction correction signal S1 output from a direction correction signal generator 21, a beam current correction signal S2 output from a beam current correction signal generator 22 and a local correction signal S3 output from a local correction signal generator 23 through a landing correction coil (LCC) driver 24.

The direction correction signal generator 21 generates the direction correction signal S1 which is a current signal corresponding to a direction code designated by a direction code switch 25 disposed on the panel surface of the cathode ray tube apparatus and supplies the same to the respective direction correction coils LCC-LT, LCC-CT, LCC-RT, LCC-LB, LCC-CB and LCC FIG. 7 shows the contents of the direction correction signal S1. Waveforms in FIG. 14 are previously stored in the direction correction signal generator 21 in response to terrestrial magnetism drifts shown in FIG. 3.

Referring back to FIG. 6, the beam current correction signal generator 22 is supplied with an automatic brightness limit (ABL) signal S4 which is a signal having a level corresponding to a beam current from a terminal 26. Then, the beam current correction signal generator 22 time-integrates the ABL signal S4 to provide the beam current correction signal S2 used to correct color displacement caused by a thermal expansion of the color selection mask and supplies the beam current correction signal S2 to the respective direction correction coils LCC-T, LCC-CT, LCC-RT, LCC-LB, LCC-CB and LCC-RB.

The local correction signal generator 23 supplies the local correction signal S3 used to carry out the landing correction peculiar to the CRT and to the respective direction correction coils LCC-LT, LCC-CT, LCC-RT, LCC-LB, LCC-CB and LCC-RB.

However, the reduction technique (1) which employs a magnetic shield encountered with the following disadvantages:

It is impractical to shield the whole of the CRT, particularly, the entire consumer CRT with an ideal magnetic material, such as permalloy or the like from a financial standpoint. Therefore, it is customary that the CRT is only partly shielded. As a result, problems of unsatisfactory beam landing and the change of image distortion caused by an imperfect magnetic shield cannot be solved perfectly. Also, there is then the problem that the weight of the cathode ray tube is increased when such a magnetic shield material is used.

The reduction technique (2) based on a degauss coil has the following disadvantages:

Although improvement can be enhanced by increasing a magnetomotive force only the degauss coil, the improvement is of about half at maximum. There is then the problem that the degree of improvement is saturated and limited. Moreover, a degauss coil for providing a large magnetomotive force requires a large amount of copper so that the degauss coil becomes large in size, expensive and heavy.

Further, the reduction technique (3) based on a correction coil has the following disadvantages:

This reduction technique is effective only in correcting the beam landing drift but it cannot correct the image distortion drift at all. Moreover, the direction correction coils LCC-LT, LCC-CT, LCC-RT, LCC-LB, LCC-CB, LCC-RB and the direction correction coil driver 24 for driving the correction coils LCC-LT, LCC-CT, LCC-RT, LCC-LB, LCC-CB and LCC-RB are large in scale. There is also the problem that the cathode ray tube apparatus becomes expensive, heavy and complicated.

SUMMARY OF THE INVENTION

In view of the foregoing, it is an object of the present invention to provide a cathode ray tube apparatus in which influences exerted on both the beam landing drift and image distortion by terrestrial magnetism applied to a cathode ray tube (CRT) can be accurately, easily and automatically corrected.

According to an aspect of the present invention, there is provided a cathode ray tube apparatus which is comprised of terrestrial magnetism sensors for outputting a terrestrial magnetism signal by detecting a terrestrial magnetism of at least one-axis direction of a tube-axis direction, a horizontal-axis direction and a longitudinal-axis direction of a face plate of a cathode ray tube, and correction coils of at least one-axis direction connected to the terrestrial magnetism sensors.

DETAILED DESCRIPTION OF THE PREFERRED EMBODIMENTS

Figure 1:
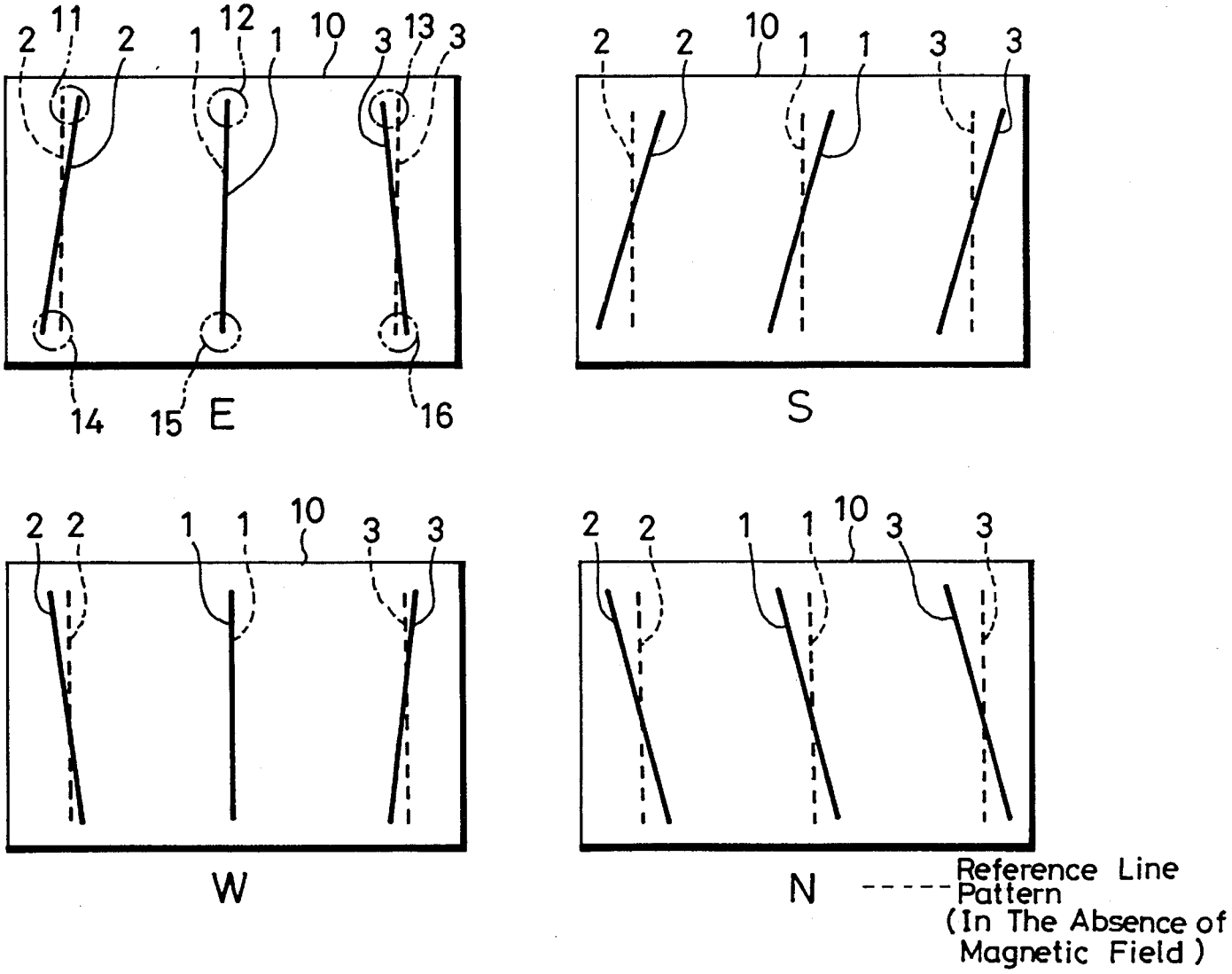
FIG. 1 is a diagram which illustrates a landing pattern drift caused by terrestrial magnetism.
Figure 2:
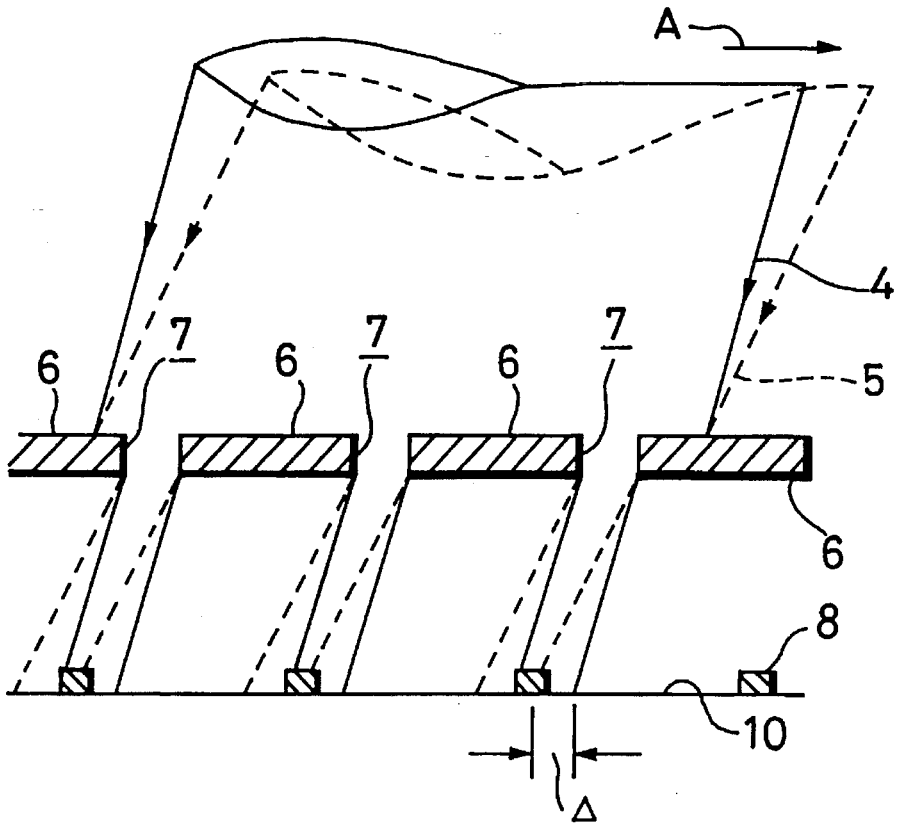
FIG. 2 is a diagram which illustrates a beam landing drift caused by an incident angle of an electron beam displaced due to terrestrial magnetism.
Figure 3:
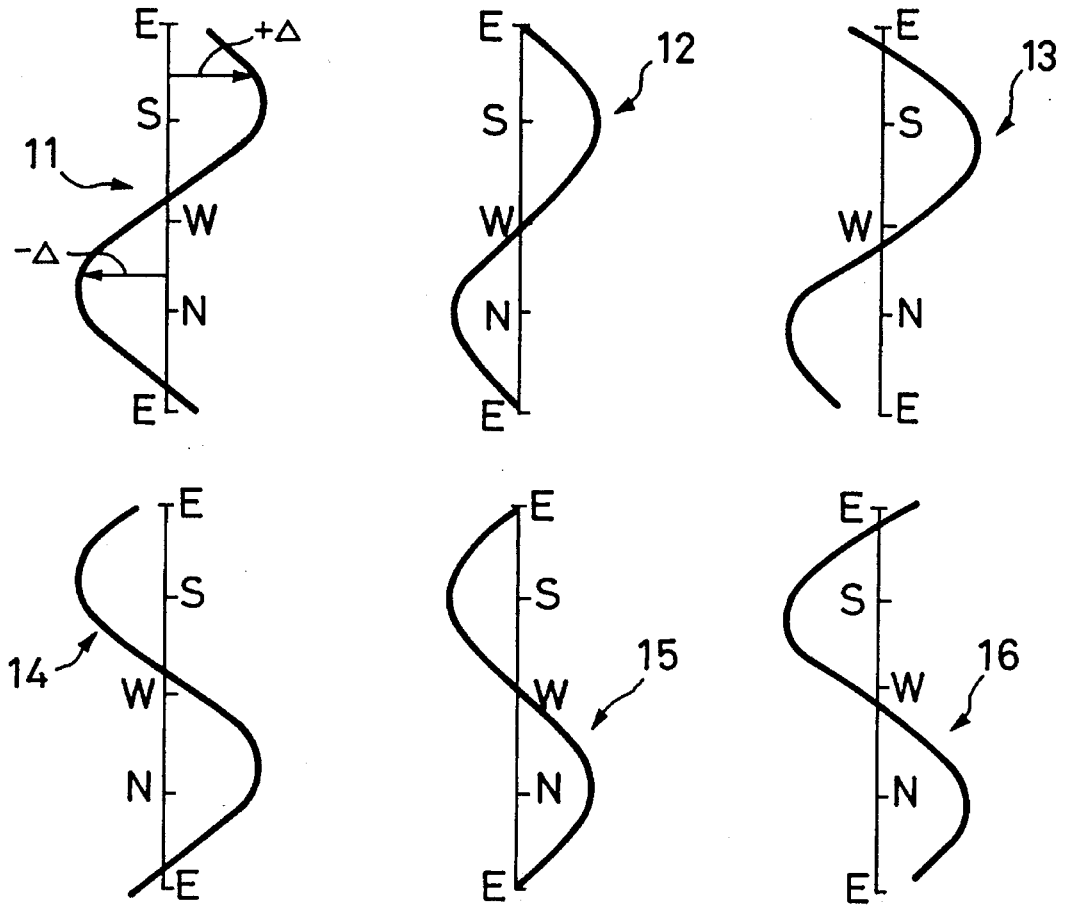
FIG. 3 is a diagram which illustrates the change of terrestrial magnetism drift caused at six points around a face plate of a cathode ray tube.
Figure 4:
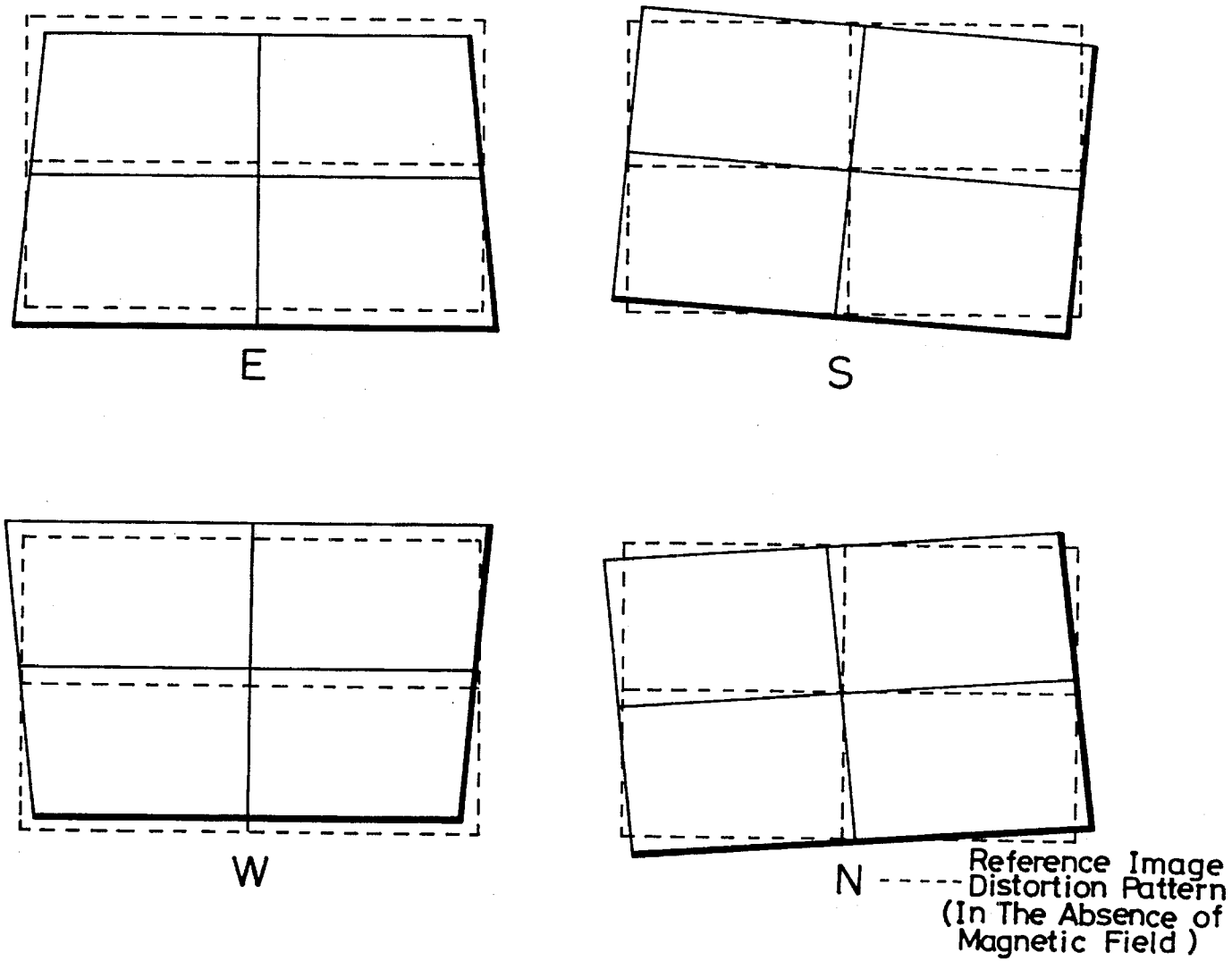
FIG. 4 is a diagram which illustrates an image distortion drift caused by terrestrial magnetism.
Figure 5:
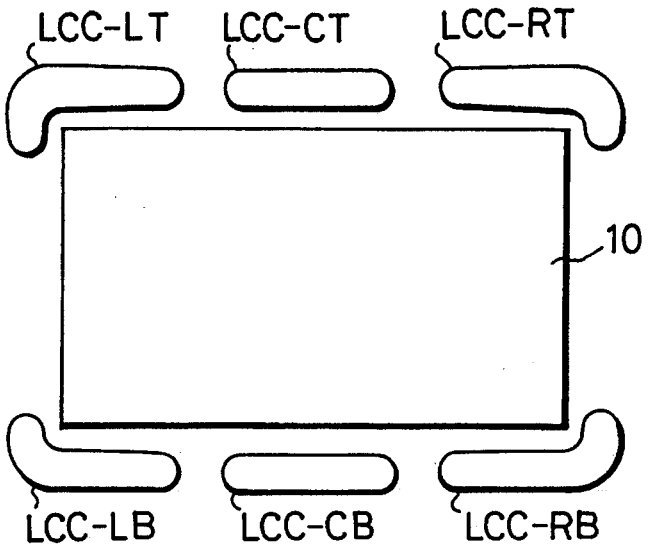
FIG. 5 is a diagram which illustrates a how to reduce a terrestrial magnetism drift by using correction coils.
Figure 6:
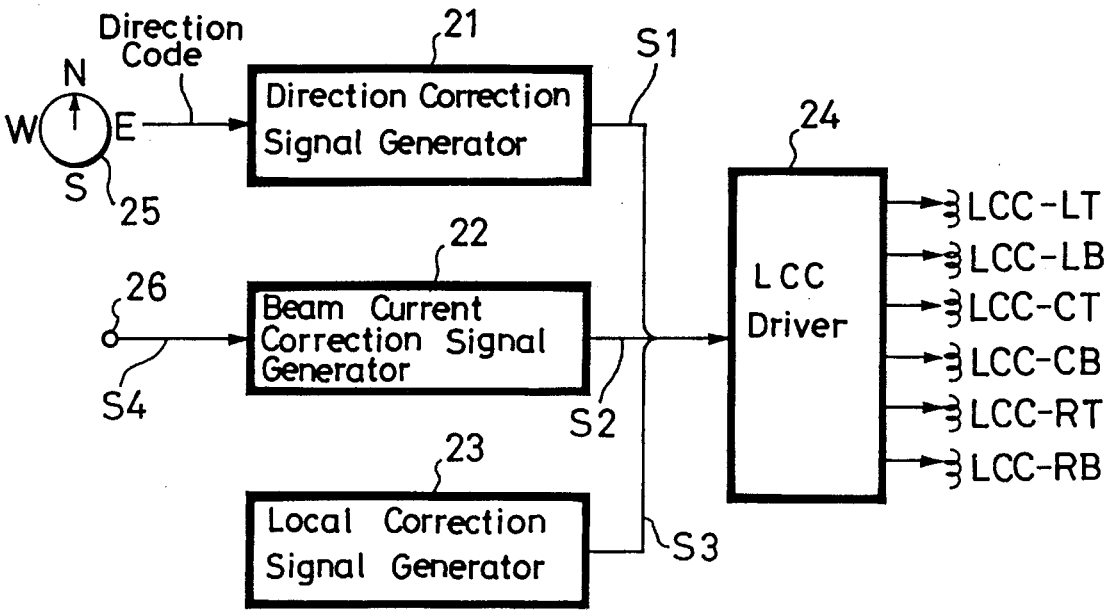
FIG. 6 is a schematic block diagram which illustrates a fundamental arrangement of a correction circuit which drives the correction coils shown in FIG. 5.
Figure 7:
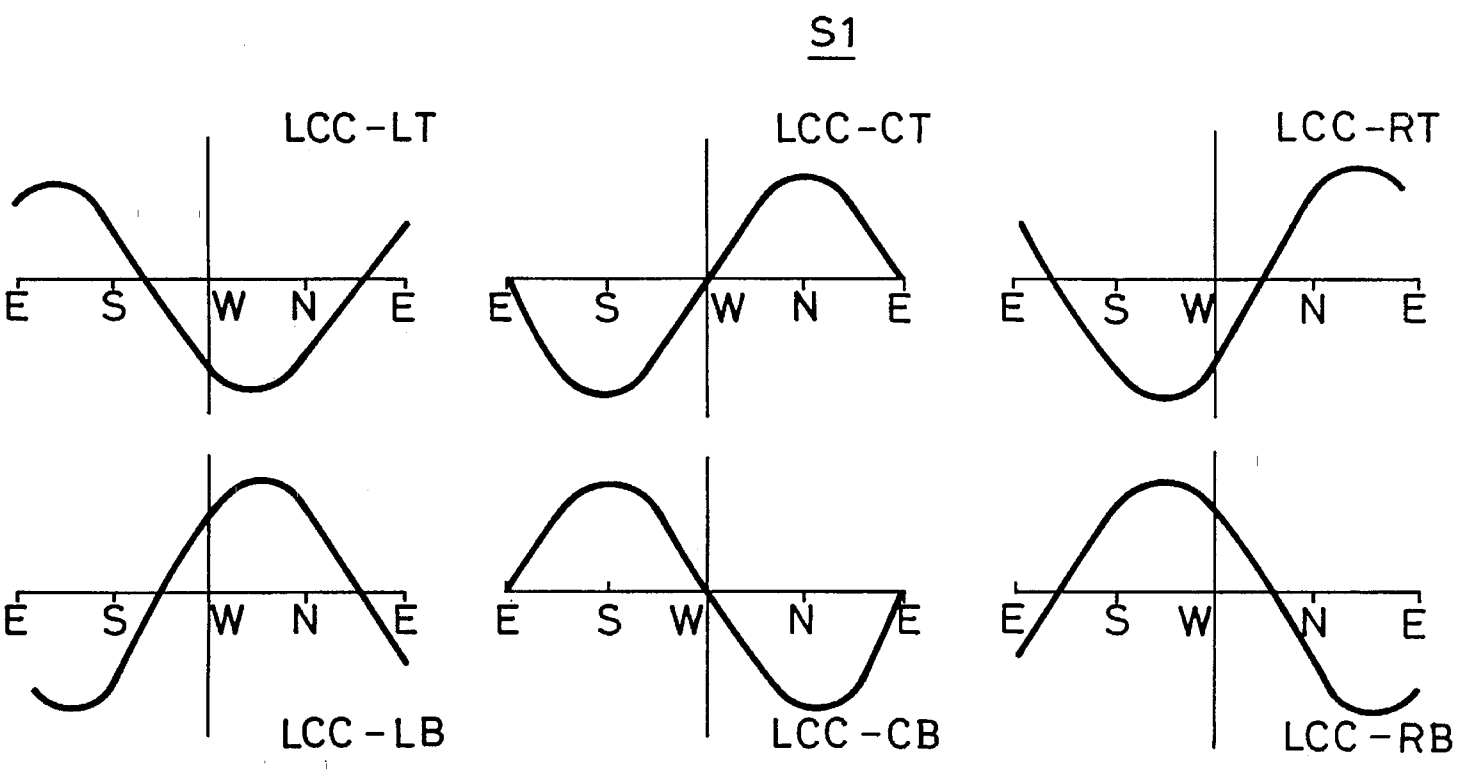
FIG. 7 illustrates a waveform diagram of a direction correction signal stored in the direction correction signal generator shown in FIG. 6.
Figure 8:
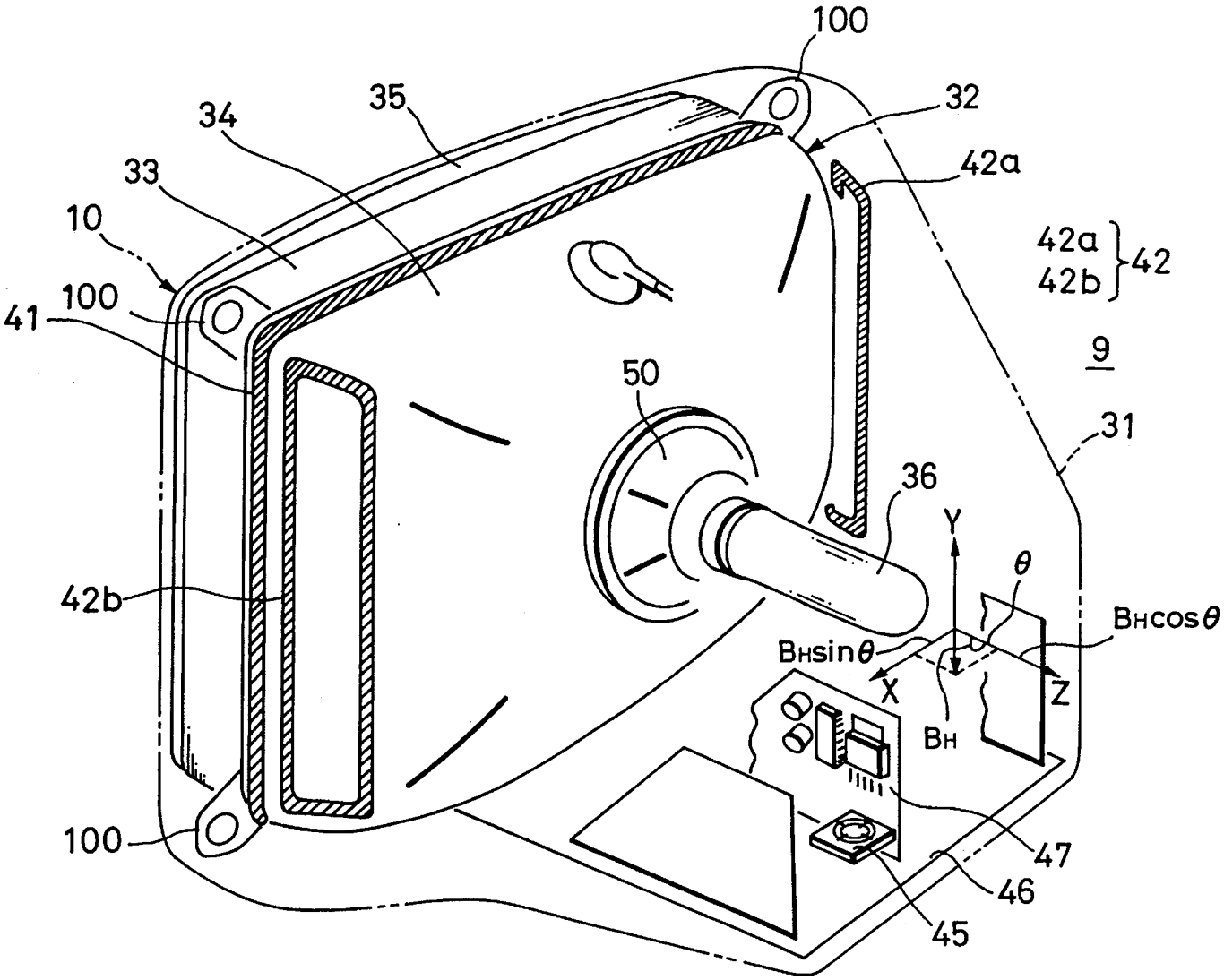
FIG. 8 is a diagram which illustrates the overall arrangement of a cathode ray tube apparatus according to a first embodiment of the present invention.

Embodiments of the present invention will hereinafter be described with reference to the drawings. In FIG. 8 and the following sheets of drawings, like parts correspond to those of FIGS. 1 to 7 and are marked with the same references.

Figure 9:
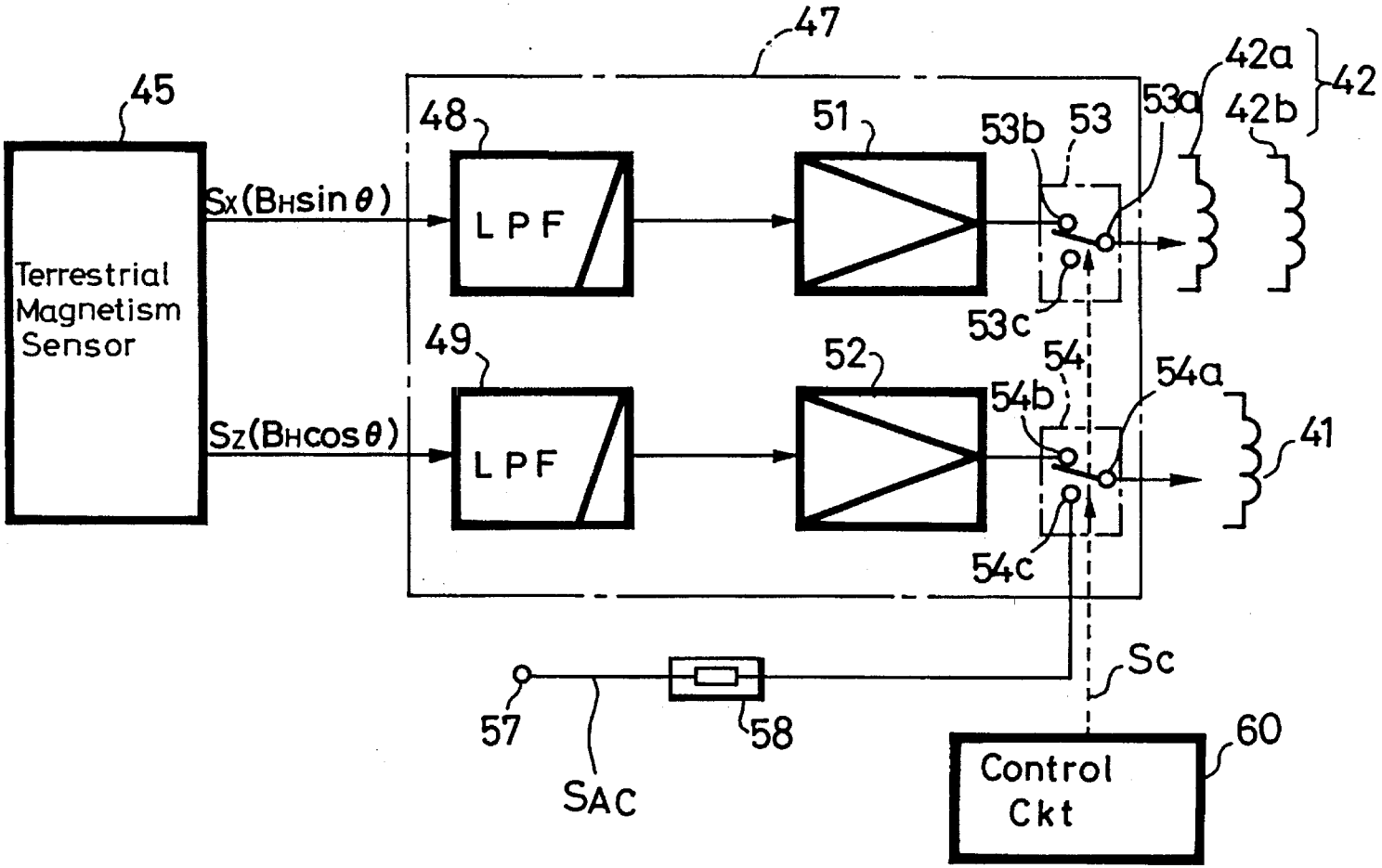
FIG. 9 is a circuit diagram which illustrates a correction circuit for the embodiment shown in FIG. 9.

FIG. 8 is a diagram showing an overall arrangement of a cathode ray tube apparatus 9 according to a first embodiment of the present invention. FIG. 9 is a block diagram which illustrates an electrical circuit used in the first embodiment of the present invention.

In the cathode ray tube apparatus 9 in the embodiment shown in FIG. 8, a casing 31 includes a color CRT 32, which is a cathode ray tube, disposed on the front side thereof. A reinforcing band 33 of this color CRT 32 is fixed around a panel portion 35 and the reinforcing band 33 includes holders 100 disposed on its four corners.

A Z-axis correction coil 41 is wound along the reinforcing band 33 and X—X axis correction coils 42 composed of two X—X axis correction coils 42*a*, 42*b* are disposed in an opposing relation on the left and right portions of a funnel portion 34.

A terrestrial magnetism sensor 45 is located at a position distant from the Z-axis correction coil 41 and the X—X axis correction coils 42, i.e., at a position which is the rearmost position of the housing 31 and which is under a neck portion 36, in other words, on a mother base plate 46 located under the electron gun. The reason that the terrestrial magnetism sensor 45 is disposed at a position distant from the Z-axis correction coil 41 and the X—X axis correction coils 42 is to detect only a terrestrial magnetism component without detecting magnetic flux from the coils 41, 42.

The terrestrial magnetism sensor 45 detects terrestrial magnetism applied to the whole cathode ray tube apparatus 9 as a terrestrial magnetism signal $B_H$ (see FIG. 8 and referred to hereinafter as "terrestrial magnetism $B_H$" for simplicity when necessary) to detect the direction at which the color CRT 32 is arranged, shown in FIG. 9 as the magnetism sensor 45 supplies, an X-axis direction terrestrial magnetism detection signal $S_X$ ($B_H$ sinθ; referred to also as "X-axis terrestrial magnetism component") and a Z-axis direction terrestrial magnetism detection signal $S_Z$ ($B_H$ cosθ; referred to also as "Z-axis terrestrial magnetism component") to low-pass filters (LPF) 48, 49 located on a a drive base plate 47. The Z-axis direction is the direction which normal to the face plate of the color CRT 32. The Y-axis direction is the direction which is normal to the longitudinal direction of the face plate of the color CRT 32.

The terrestrial magnetism sensor 45 can be formed as a well-known terrestrial magnetism sensor and may be formed of a magnetic field measuring apparatus using a flux gate, for example. The magnetic field measuring apparatus is made in view of the fact that magnetic permeability, loss and magnetic flux of a magnetic material change when the magnetic material, such as permalloy or the like, is disposed in a measured magnetic field under the condition that the magnetic material is symmetrically and periodically excited by an alternate time. Accordingly, this magnetic field measuring apparatus makes effective use of the fact that changed amounts of magnetic permeability, loss and magnetic flux are proportional to the magnitude of the magnetic field (see "Introduction of Magnetic Engineering" written by Kenji Narita and published by OHMSHA LTD., on Jul. 10, 1965).

The terrestrial magnetism sensor 45 is not limited to a magnetic field measuring apparatus which uses a flux gate and it is possible to use an apparatus which makes an effective use of a Hall element and an apparatus which makes an effective use of a magnetoresistance element.

The LPFs 48, 49 are designed to cancel the influence of a noise AC magnetic field (leakage magnetic field generated from devices, such as the deflection yoke 50, or a flyback transformer, etc. which is) generated within the cathode ray tube apparatus 9. The X-axis direction terrestrial magnetism detection signal $S_X$ ($B_H$ sinθ) and the Z-axis direction terrestrial magnetism detection signal $S_Z$ ($B_H$ cosθ) from which the influence of the noise AC magnetic field was removed are respectively supplied to amplifiers 51, 52. If the frequency characteristics of the terrestrial magnetism sensor 45 and (or) amplifiers 51, 52 are set to low-pass characteristics, then it becomes possible to omit the LPFs 48, 49.

The amplifiers 51, 52 supply coil correction currents corresponding to the X-axis direction terrestrial magnetism detection signal $S_X$ ($B_H$ sinθ) and the Z-axis direction terrestrial magnetism detection signal $S_Z$ (BE cosθ) through a fixed contact 53*b* and a common contact 53*a* of a switcher 53 and a fixed contact 54*b* and a common contact 54*a* of a switcher 54 to the X—X axis correction coil 42 and the Z-axis correction coil 41. Thus, the X—X axis correction coil 42 and the Z-axis correction coil 41 generate magnetic field components which can cancel the terrestrial magnetism components $B_H$ sinθ, $B_H$ cosθ (see FIG. 8) in the X-axis direction and in the Z-axis direction, i.e., opposite direction magnetic filed (magnetic flux) components which are the same in magnitude substantially within the funnel portion 34. The orientations (directions) of the resultant magnetic fluxes are varied by the winding direction of the correction coils 41, 42 or the like.

The reason that the switchers 53, 54 are provided in the block diagram shown in FIG. 9 is to make the Z-axis correction coil 41 serve both as a correction coil and a degaussing coil. An AC voltage $S_{AC}$, which is supplied through a terminal 57, is supplied to the fixed contact 54*b* of the switcher 54 through a PTC (a resistor element having a positive temperature coefficient characteristic) 58. When an AC power supply is energized, from a control circuit 60, the switchers 53, 54 are supplied at their switching control terminals with a control signal Sc by which the common contacts 53*a*, 54*a* are switched to the fixed contacts 53*c*, 54*c* only during a constant time period necessary for degaussing. Therefore, due to the function of the PTC 58, the Z-axis correction coil 41 is supplied with an AC attenuation vibration degaussing current only during the constant time period.

In this case, during the constant time period when the AC power supply is energized, in other words, during the degaussing operation, the switcher 53 is switched to the fixed contact 53*c* so that the correction current supplied to the X—X axis correction coil 42 is canceled. Thus, a so-called magnetic transcription effect caused by the X—X axis correction coil 42 is excluded and it is possible to effectively degauss the magnetic member, such as the color selection mask, the internal magnetic shield (the internal magnetic shield may be removed in this embodiment), not shown, with magnetic flux parallel to the tube axis (Z axis) generated by the Z-axis correction coil 41. As the control circuit 60, it is possible to use a microcomputer or a timer using a counter. When the Z-axis correction coil 41 does not serve both as the correction coil and the degauss coil, the switchers 53, 54 need not be provided. Also, it is needless to say that a degauss coil may be provided separately.

As described above, since the amplifiers 51, 52 are adapted to supply coil correction currents proportional to the X-axis direction terrestrial magnetism detection signal $S_X$ ($B_H$ sinθ) and Z-axis direction terrestrial magnetism detection signal $S_Z$ ($B_H$ cosθ), it is optimum to use current feedback type amplifiers as the amplifiers 51, 52.

Figure 10:
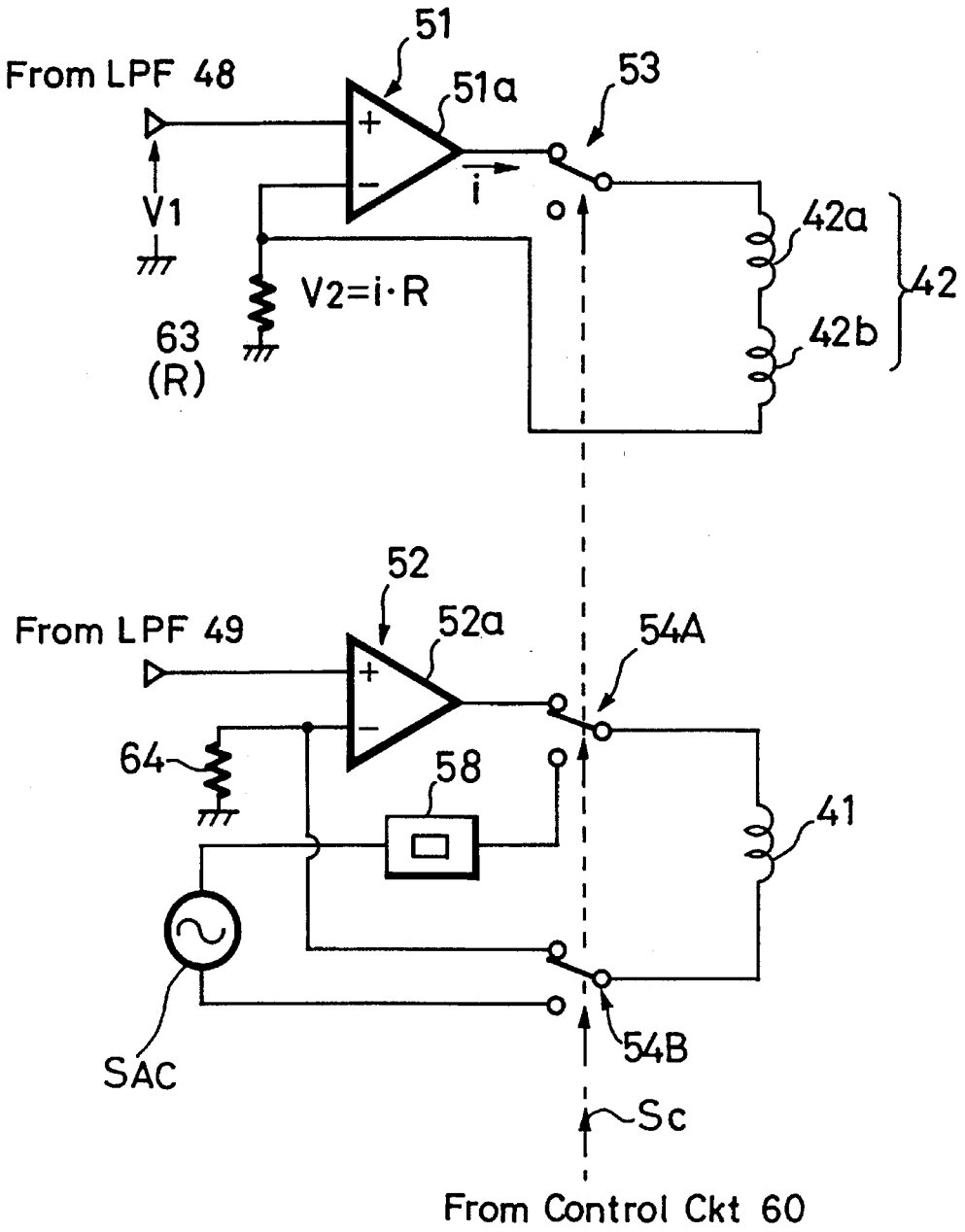
FIG. 10 is a circuit diagram which illustrates the correction coils and current feedback amplifiers which drive the correction coils.

FIG. 10 is a circuit diagram showing the amplifiers 51, 52 each composed of the current feedback type amplifier in detail. In FIG. 10, reference symbol i assumes a current supplied from an operational amplifier 51*a* constructing the amplifier 51 to the series-connected X—X axis correction coils 42 (42*a*, 42*b*), V1 assumes a voltage developed at a positive input terminal of the operational amplifier 51, and $V2=i\times R$ (R is a resistance value of a resistor 63) developed at a negative input terminal of the operational amplifier 51. Then, a feedback is effected so as to cancel a difference of voltages developed between the positive and negative input terminals of the operational amplifier 51*a*. Therefore, the current feedback type amplifier is used in order to determine the coil correction current i by $i=V1/R$ with ease. As shown in FIG. 10, on the Z-axis correction coil 41 side, the current feedback type amplifier is constructed by mutual connection of the operational amplifier 52*a*, a resistor 64, switchers 54A, 54B or the like.

As shown in FIG. 10, the left and right two X—X axis correction coils 42*a*, 42*b* are electrically connected in series (may be electrically connected in parallel) and driven only by the operational amplifier 51*a*. The X—X axis correction coil 42 generates horizontal (extended along the horizontal axis of the face plate) parallel magnetic flux in the inside of the funnel portion 34.

As described above, according to the first embodiment shown in FIGS. 8 to 10, although the cathode ray tube apparatus 9 is rotated at any angle within the horizontal plane, the beam landing drift and the image distortion drift can automatically be corrected to optimum ones. Although no countermeasure is taken for the vertical direction terrestrial magnetism component, it is customary that cathode ray tubes are adjusted in accordance with destinations and shipped by the production lines of factory in which the vertical direction terrestrial magnetism component is deliberately set and considered. Therefore, it is sufficient to carry out the correction of two axes of the X axis and the Z axis. The beam landing drift and the image distortion drift caused by the change of the vertical direction terrestrial magnetism component are simple ones, i.e., moved in parallel to the horizontal axis direction of the face plate 10.

Figure 11:
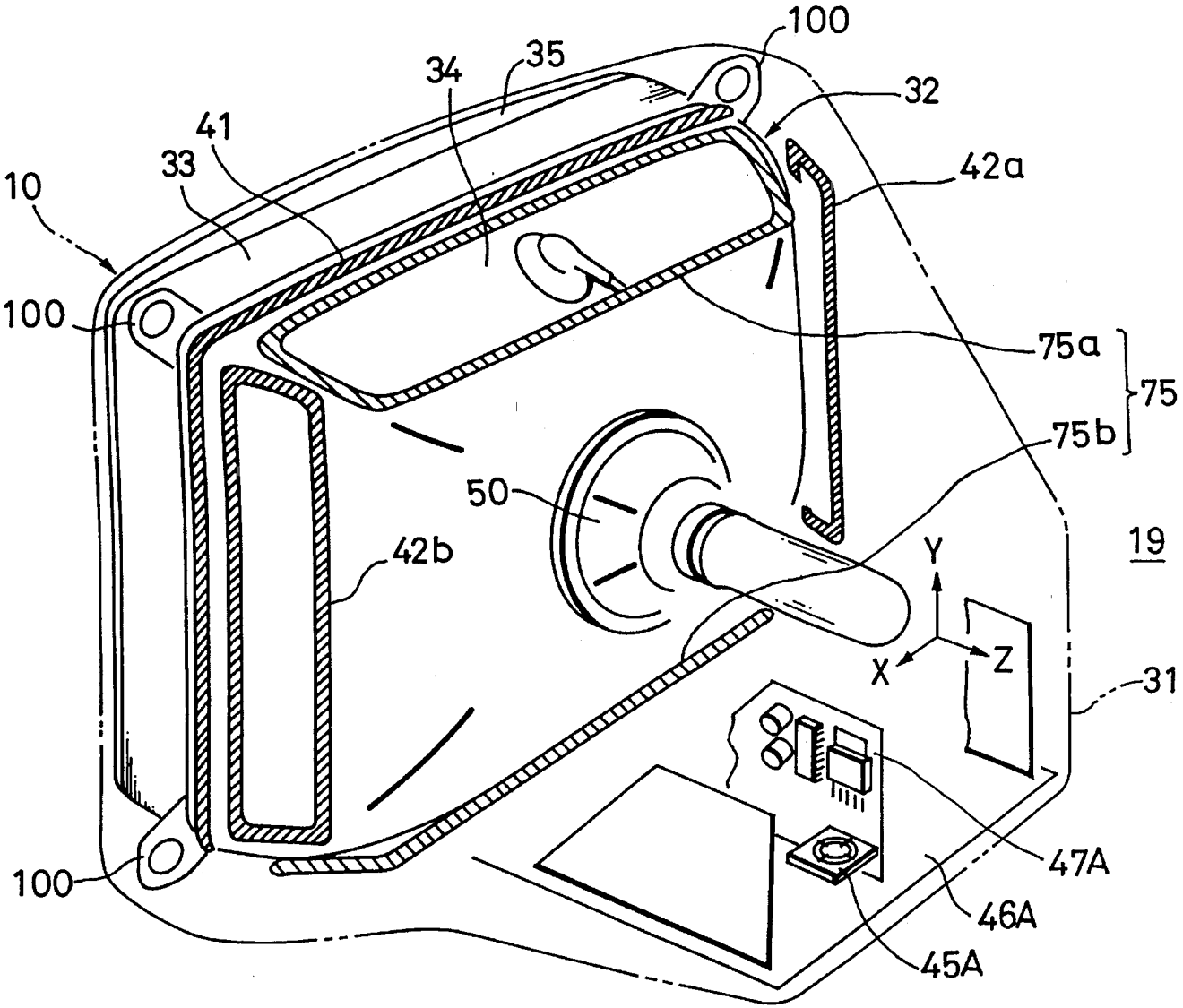
FIG. 11 is a diagram which illustrates an arrangement of a cathode ray tube apparatus according to a second embodiment of the present invention.

FIG. 11 is a conceptual diagram showing an overall arrangement of a cathode ray tube apparatus 19 according to a second embodiment of the present invention in which a correction of a vertical direction component of terrestrial magnetism also is taken into consideration.

Figure 12:
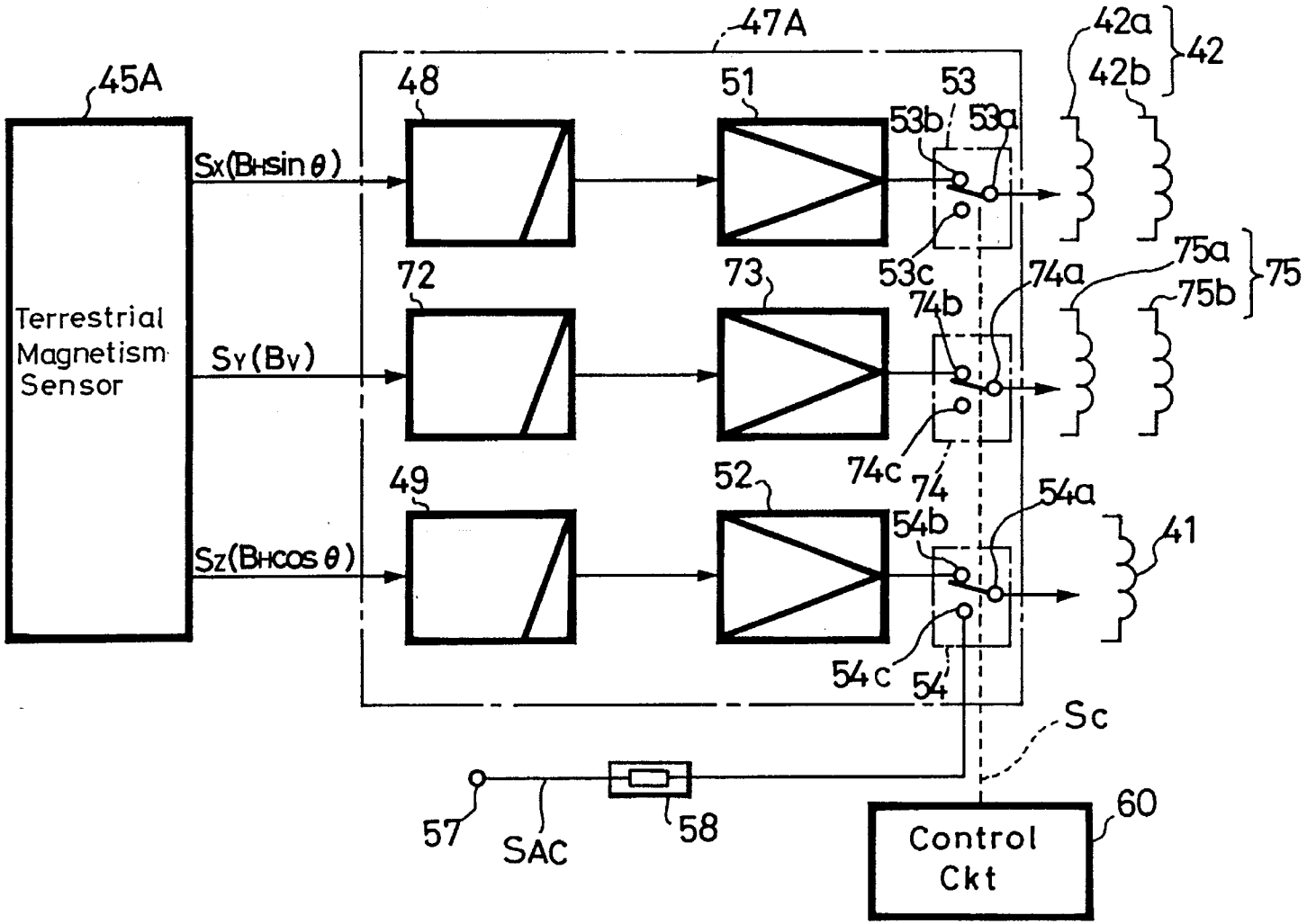
FIG. 12 is a block diagram which illustrates a correction circuit used in the second embodiment shown in FIG. 11.

FIG. 12 is a block diagram showing an electrical circuit used in the second embodiment of the present invention.

In FIGS. 11 and 12, like parts corresponding to those of FIGS. 8 to 10 are marked with the same references and therefore need not be described in detail.

In the second embodiment shown in FIGS. 11 and 12, in addition to the Z-axis correction coil 41 wound along the reinforcing band 33 and the X—X axis correction coil 42 composed of the two X—X axis correction coils 42*a*, 42*b* disposed on the left-hand side and right-hand side of the funnel portion 34, there is provided a Y—Y axis correction coil 75 composed of two Y—Y axis correction coils 75*a*, 75*b* which are opposed to each other in the upper and lower direction of the funnel portion 34. The Y—Y axis correction coils 75*a*, 75*b* are driven by a single drive source (amplifier 73) and electrically connected in series or in parallel to each other.

Figure 13:
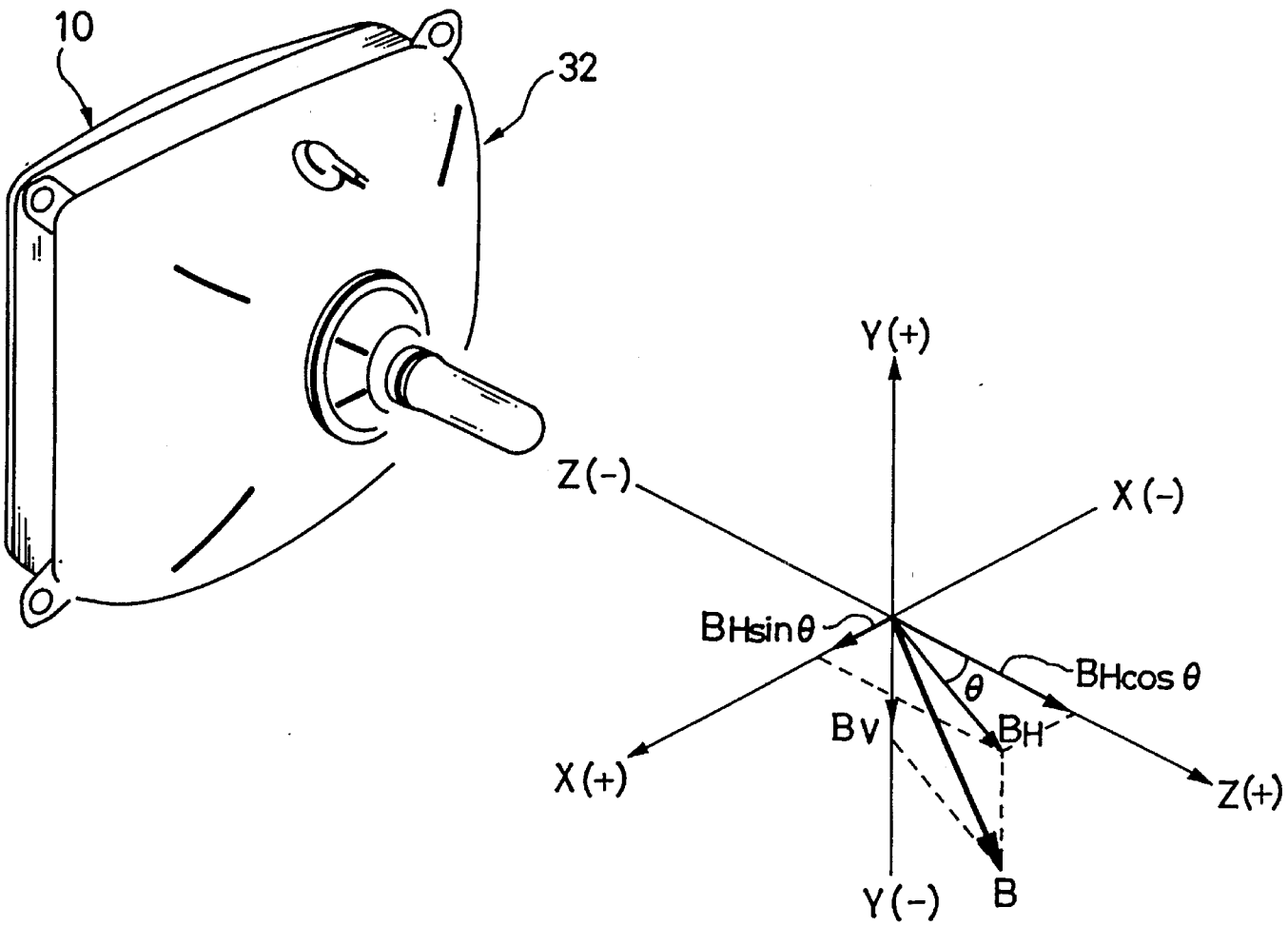
FIG. 13 is a diagram which illustrates the relationship between a CRT and a terrestrial magnetic field.

FIG. 13 is a diagram used to explain a terrestrial magnetism component detected by the terrestrial magnetism sensor 45A according to the second embodiment shown in FIGS. 11 and 12. The terrestrial magnetism sensor 45A detects a terrestrial magnetism B applied to the whole of the cathode ray tube apparatus 19 as a horizontal plane terrestrial magnetism signal $B_H$ and a vertical plane terrestrial magnetism signal By. As described above, the horizontal plane terrestrial magnetism signal $B_H$ is analyzed into the X-axis direction terrestrial magnetism detection signal $S_X$ ($B_H \sin\theta$) and the Z-axis direction terrestrial magnetism detection signal $S_Z$ ($B_H \cos\theta$) and then output from the terrestrial magnetism sensor 45A. Further, the vertical plane terrestrial magnetism signal $B_V$ is output as a Y-axis direction terrestrial magnetism signal $B_V$ (also referred to as "Y-axis terrestrial magnetism component") and supplied through a low-pass filter 72, an amplifier 73 and a switcher 74 to the Y—Y axis correction coil 75. When these correction coils 41, 42 and 75 generate corresponding magnetic fluxes which are used to cancel respective terrestrial magnetism components in the direction opposite to the terrestrial magnetism components, the beam landing drift and the image distortion drift can be corrected. Incidentally, it is possible to form the terrestrial magnetism sensor 45A by using the flux gate or the like with ease.

While the Z-axis correction coil 41 is served both as the correction coil and the degauss coil as described above in the second embodiment shown in FIGS. 11 and 12, the present invention is not limited thereto and the following variant also is possible. For example, when the Y—Y axis correction coil 75 is served both as the correction coil and the degauss coil, this is particularly effective for CRTs having an aperture grille with a stripe structure of vertical axis (Y axis) and a color selection mask such as a slot mask or the like.

As described above, according to the second embodiment shown in FIGS. 11 and 12, since orthogonal three-axis (X-axis, Z-axis and Y-axis) components of the terrestrial magnetism B are detected and the beam landing drift and the image distortion drift can be corrected, it is possible to completely and automatically correct the beam landing drift and the image distortion drift regardless of the direction to which the cathode ray tube apparatus 19 is faced. Therefore, the present invention is particularly suitable as being applied to a cathode ray tube apparatus mounted within an airplane or vehicle which can be moved in a long distance, a cathode ray tube apparatus having a tilt-swivel mechanism or a cathode ray tube apparatus whose sales area is not specified.

In this case, the terrestrial magnetism sensors 45, 45A, the correction coils 41, 42 and 75 and the relating circuits which are used to correct the beam landing drift and the image distortion drift according to the embodiments of the present invention can be simplified in arrangement and reduced in weight as compared with those using the magnetic shield mechanism and the degauss coil. Therefore, the cathode ray tube apparatus can be reduced in weight and can become inexpensive on the whole.

It is possible to calculate the direction of the terrestrial magnetism $B_H$ by adding the output signal of the LPF 48 and the output signal of the LPF 49 by using a calculation apparatus (not shown), such as a microcomputer or the like, in a vector fashion. Then, on the basis of the calculated result, it is possible to display the direction of the cathode ray tube apparatus 9, 19 on the face plate 10 in a superimposed fashion on a picture instead of the picture displayed on the face plate 10. It is needless to say that the direction can be displayed without calculation if a ROM (read-only memory) is used as a look-up table.

Figure 14A:
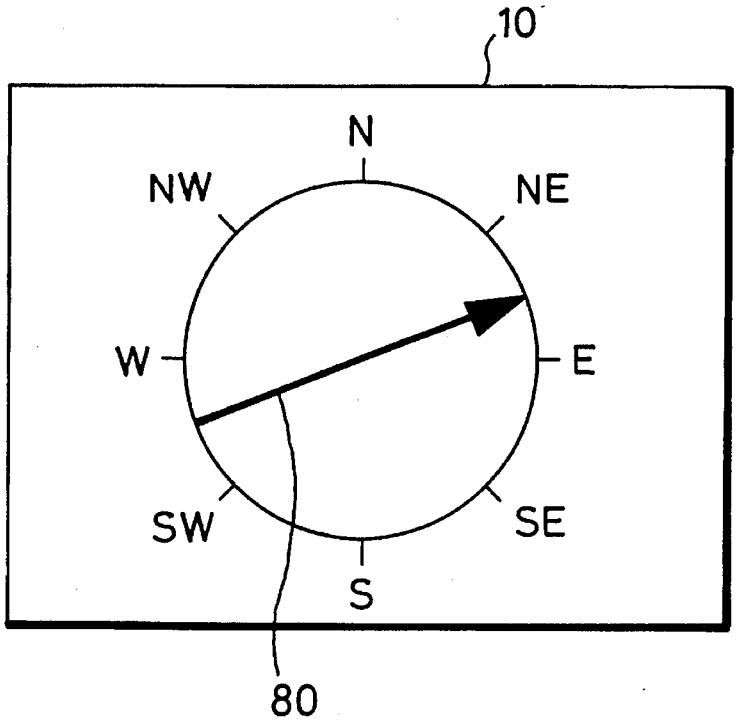
FIGS. 14A and 14B are diagrams which illustrate a face plate direction display function.
Figure 14B:
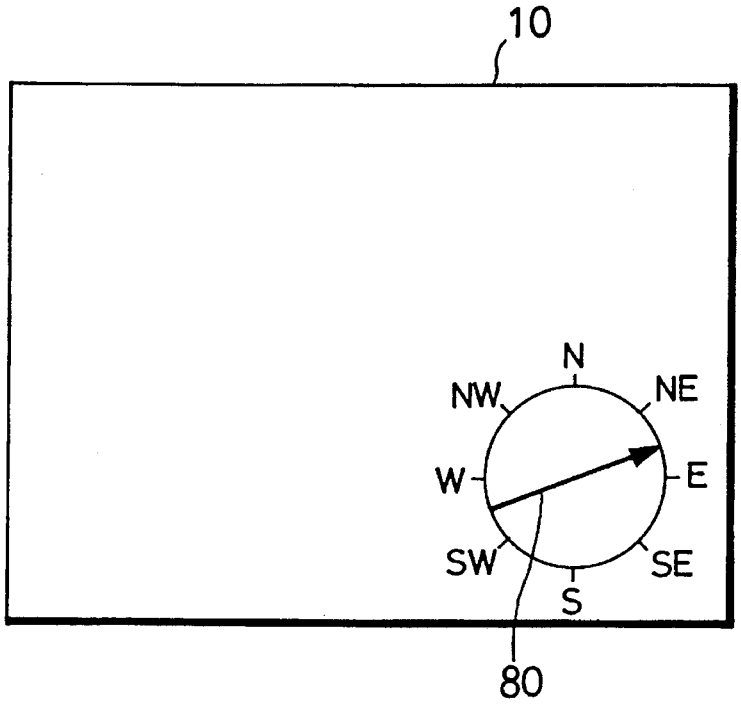

FIGS. 14A and 14B are diagrams showing displayed examples of the directions of the terrestrial magnetisms on the face plate 10 (in FIGS. 14A and 14B, reference symbols N, E, S and W represent ordinary direction displays). In FIGS. 14A and 14B, a direction shown by an arrow 80 represents the terrestrial magnetism direction (east-northeast in the illustrated examples). FIG. 14A shows the state that the terrestrial magnetism direction is displayed on the whole of the face plate 10, and FIG. 14B shows the state that the terrestrial magnetism direction is displayed on the corner of the face plate 10. If the terrestrial magnetism direction is displayed as shown in FIGS. 14A and 14B, then it is possible to confirm the operated state of the terrestrial magnetism drift automatic correction. Alternatively, the cathode ray tube apparatus according to the present invention can be used as an electronic compass when the cathode ray tube apparatus is mounted on the vehicle.

As described above, according to the embodiments of the present invention, since the detected outputs of the orthogonal two-axis components (X-axis and Z-axis) or orthogonal three-axis components (X-axis, Z-axis and Y-axis) of the terrestrial magnetism B detected by the terrestrial magnetism sensors 45, 45A disposed within the cathode ray tube apparatus 9, 19 are amplified in current to drive a plurality of correction coils 41, 42 and 75 disposed around the color CRT 32, the following various effects can be achieved:

It is possible to completely and automatically correct the peculiar beam landing drift and the image distortion drift caused by the terrestrial magnetism;

It becomes possible to simplify the magnetic shield and the degauss coil. Thus, the cathode ray tube apparatus can be made light in weight and inexpensive;

Since the beam landing clearance of the CRT itself can be reduced, designing and manufacturing of CRT can be made easy. Also, since yield of the CRT can be increased, a large-sized high definition cathode ray tube can be manufactured with ease;

Adjustment required when the cathode ray tube apparatus is installed, i.e., installment adjustment can be removed and therefore a distribution cost and a service cost can be reduced;

If the three-axis correction is carried out, then it is possible to render the cathode ray tube apparatus a tile-swivel function of a wide range; and It is possible to add a new function, such as to display a direction on the face plate or the like, to the cathode ray tube apparatus.

As described above, according to the present invention, a terrestrial magnetism of at least one axis direction of the tube-axis direction, the horizontal-axis direction and the longitudinal-axis direction of the face plate of the cathode ray tube is detected by the terrestrial magnetism sensor and the terrestrial magnetism signal thus detected is output to the correction coils of at least one axis direction. Therefore, it is possible to reduce the influences exerted on both of the beam landing drift and the image distortion drift by the terrestrial magnetism applied at least to one axis direction of the CRT.

According to the present invention, the terrestrial magnetisms of the tube-axis direction and the horizontal-axis direction of the cathode ray tube are detected by the terrestrial magnetism sensor and the tube-axis direction terrestrial magnetism signal and the horizontal-axis direction terrestrial magnetism signal thus detected are output to the tube-axis direction correction coil and the horizontal-axis direction correction coil, respectively. Therefore, it is possible to reduce the influences exerted on both of the beam landing drift and the image distortion drift by the terrestrial magnetism applied to the tube-axis direction and the horizontal-axis direction of the CRT.

According to the present invention, the terrestrial magnetisms of the tube-axis direction, the horizontal-axis direction and the longitudinal-axis direction are detected by the terrestrial magnetism sensor and the tube-axis direction terrestrial magnetism signal, the horizontal-axis direction terrestrial magnetism signal and the longitudinal-axis direction terrestrial magnetism signal thus detected are output to the tube-axis direction correction coil, the horizontal-axis direction correction coil and the longitudinal-axis direction correction coil, respectively. Therefore, it is possible to reduce the influences exerted on both of the beam landing drift and the image distortion drift by terrestrial magnetisms applied to the tube-axis direction, the horizontal-axis direction and the longitudinal-axis direction of the CRT.

Further, according to the present invention, since the correction coil is served both as the correction coil and the degauss coil, the degauss coil need not be provided as a separate member.

Furthermore, according to the present invention, since the display representing the direction based on the terrestrial magnetism signal is made on the face plate of the CRT, it is possible to know the direction based on the direction display.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A cathode ray tube apparatus comprising:

a first axis which is coincident with a tube axis of a tube face of a cathode ray tube;

a second axis which is coincident with a lateral axis of the tube face of a cathode ray tube;

a terrestrial magnetism sensor for outputting a signal corresponding to a sensed magnetic field, the sensor being secured within a housing for the cathode ray tube at a location which is substantially removed from a screen of the cathode ray tube;

a first axis correction coil having a perimeter adjacent to a perimeter of a reinforcing band;

a second axis correction coil comprised of two coils disposed at the right and left sides of a funnel portion of the cathode ray tube, the second axis correction coil generating a magnetic flux directed in the second axis direction in parallel within the funnel portion; and wherein the magnetism sensor is electrically connected to the first and second axis correction coils for providing respective first and second axis magnetism signals.

2. A cathode ray tube according to claim 1, further comprising a third axis which is coincident with the longitudinal axis of said tube face of said cathode ray tube, a third axis correction coil which is electrically connected to said magnetism sensor formed of two pieces of coils which are provided on the upper and lower sides of said funnel portion.

3. A cathode ray tube apparatus according to claim 1, further comprising a switch having a first input connected to an output of the magnetic sensor, a second input connected to an AC voltage source and an output connected to the first axis correction coil, wherein the switch is capable of alternately applying the AC voltage source and the first axis magnetism signal to the first correction coil.

4. A cathode ray tube apparatus according to claim 1, wherein said cathode ray tube further comprises a means for calculating a direction signal representative of an orientation of the cathode ray tube with respect to an external magnetic field and displaying a visual signal on the cathode ray tube which identifies the orientation of the cathode ray tube with respect to the external magnetic field.

5. A cathode ray tube apparatus according to claim 2, further comprising a switch having a first input connected to an output of the magnetic sensor, a second input connected to an AC voltage source and an output connected to the third axis correction coil, wherein the switch is capable of alternately applying the AC voltage source and the third axis magnetism signal to the third correction coil.

6. A cathode ray tube according to claim 1, wherein said second axis correction coil serves a degaussing function.

7. A cathode ray tube according to claim 1, wherein said third axis correction coil serves a degaussing function.

8. A cathode ray tube apparatus comprising:

a terrestrial magnetism sensor for outputting a signal corresponding to a sensed magnetic field, the sensor being secured within a housing for the cathode ray tube at a location which is substantially removed from a screen of the cathode ray tube;

a first axis correction coil adjacent to a reinforcing band;

a second axis correction coil secured to a funnel of the cathode ray tube and wherein the magnetism sensor is electrically connected to the first and second axis correction coils for providing respective first and second axis magnetism signals, wherein said cathode ray tube further comprises a means for calculating a direction signal representative of an orientation of the cathode ray tube with respect to an external magnetic field and displaying a visual signal on the cathode ray tube which identifies the orientation of the cathode ray tube with respect to the external magnetic field.

* * * * *